United States Patent [19]

Vielstich et al.

[11] 4,441,190

[45] Apr. 3, 1984

[54] COUPLING DEVICE FOR ARC FURNACE ELECTRODES

[75] Inventors: Günther Vielstich, Witten; Hanns-Georg Bauer, Witten-Bommern; Josef Mühlenbeck; Josef Otto, both of Wetter; Horst Feldhoff, Witten; Dieter H. Zöllner, Schwaig b. Nürnberg; Friedrich Rittmann, Rückersdorf b. Nürnberg, all of Fed. Rep. of Germany

[73] Assignee: Arc Technologies Systems Ltd., Grand Cayman, Cayman Islands

[21] Appl. No.: 332,158

[22] Filed: Dec. 18, 1981

[30] Foreign Application Priority Data

Dec. 17, 1980 [DE] Fed. Rep. of Germany ..... 3047620

[51] Int. Cl.[3] ..... H05B 7/101

[52] U.S. Cl. ..... 373/94

[58] Field of Search ..... 373/94, 93, 92

[56] References Cited

U.S. PATENT DOCUMENTS

| | | | |
|---|---|---|---|
| 824,153 | 6/1906 | Seward . | |
| 3,526,699 | 9/1970 | Usherwood | 373/94 |

FOREIGN PATENT DOCUMENTS

| | | | |
|---|---|---|---|
| 730228 | 3/1966 | Canada | 373/94 |
| 422777 | 12/1925 | Fed. Rep. of Germany | 373/94 |
| 15049 | of 0000 | Fed. Rep. of Germany . | |
| 350833 | 6/1905 | France | 373/94 |
| 42439 | 2/1926 | Norway | 373/94 |

*Primary Examiner*—Roy N. Envall, Jr.
*Attorney, Agent, or Firm*—Woodrow W. Ban

[57] ABSTRACT

A coupling means for the suspension of electrodes for arc furnaces from a lifting appliance comprising: a controllable locking device detachably engaging a connector element attached to an electrode; an entry guide arrangement for guiding the connector element into a position for engagement by the locking device; and a suspension means for the suspension of the coupling means on the lifting appliance, and including shock-absorbing means permitting relative motion parallel to a direction of insertion of the connector element between the suspension means and the locking device.

16 Claims, 4 Drawing Figures

COUPLING DEVICE FOR ARC FURNACE ELECTRODES

The invention concerns a coupling device for the suspension from a lifting appliance of electrodes used in arc furnaces.

In arc furnaces, especially those for the production of electrosteel, rather heavy electrodes are used, especially in the case of large arc furnaces. Such electrodes can therefore only be manipulated by a robust lifting appliance, e. g. by a gantry crane. For this purpose the electrode concerned is lifted directly on the hook of the lifting appliance by means of a connector element. Both the attachment of the electrode to the lifting appliance and the detachment of the electrode therefrom are frequently performed by a single operator who either attaches the hook of the lifting appliance onto the connector element of the electrode or removes the hook from the connector element again. Even in the normal transport of heavy goods by a lifting appliance, the attachment of the heavy goods to the hook and the detachment of the goods from the hook is heavy work, which moreover can be dangerous. When servicing the electrodes of the type in question, an arc furnaces, such hookup activity is made substantially more difficult. To insert a new electrode in an arc furnace, this electrode has to be introduced through an opening in the roof of the furnace by means of the lifting appliance. After the introduction of the electrode into the opening in the roof, a worker then has to climb onto the gantry of the furnace and release the hook of the lifting appliance from the newly installed electrode. When the electrode is readjusted having been partially consumed, again a worker has to climb onto the gantry of the arc furnace, in order to attach the hook of the lifting appliance to the electrode, so that the driver of the lifting appliance, after the release of any electrode securing device retaining the electrode to the arc furnace, can adjust the electrode on the roof, whereupon the worker again must detach the hook of the lifting appliance from the electrode. The same applies to the replacement of an expended electrode. In this case too a worker has to mount the gantry of the arc furnace, in order to connect up the hook of the lifting appliance to the connector element of the electrode which has been consumed, so that this consumed electrode can be removed from the arc furnace vessel or from the opening in the roof of the arc furnace. Since all this work takes place during operation of the arc furnace, the worker is exposed on the gantry of the arc furnace to substantial heat. Moreover the work, as one can easily imagine, is naturally not without its dangers.

An interruption of the operation of the furnace or a reduction in the temperature for the duration of the work would lead to unacceptably high losses in throughput and energy losses.

Furthermore, in the known method of handling the electrodes for arc furnaces, it was possible only by lengthy manual work or by the use of complicated devices to connect new active portions to a partially-expended electrode. The connection of a new active portion to a partially expended electrode is made by means of screw nipples, which are screwed into blind holes of the two portions of the electrodes to be connected. Thus, to do this, the heavy electrode portions have to be rotated against each other. According to the prior art, this is achieved either manually or by means of complicated specially designed devices. In the latter case, the electrodes have to be inserted in the special device for the process of the connection of a new active portion to a partly-expended electrode, and after the connection of a new active portion, the electrode must again be removed from this device and returned to the arc furnace.

But in the known method of handling the relevant electrodes, the fact that the manual work to be done by the workers is difficult and partially dangerous is not the only disadvantage. There is also the further serious disadvantage that this work is very time-consuming. Thus for example the adjustment of the electrodes described above takes about 5–10 minutes. Yet an electrode has to be adjusted repeatedly during a shift, e.g. five or six times. However, because of the necessary manual labor, the overall procedure involved in transportation of the electrodes by means of a suitable lifting appliance is extremely time-consuming.

The invention therefore has the object of providing a device which makes it possible to couple electrodes automatically with a lifting device, so that the entire handling of the electrodes can be carried out much faster, and in addition heavy and dangerous manual labor can be avoided.

This object is attained by a coupling means for coupling electrodes for arc furnaces to a lifting appliance, characterized in that said coupling means comprises: a controllable lock or locking device for detachably engaging a connector element of an electrode; an entry guiding means for guiding said connector element in an insertion direction along an insertion axis to the locking device and a suspension means for attachment to said lifting appliance and including a shock-absorbing means permitting relative motion parallel along said insertion axis between said suspension device and said locking device.

The coupling means of the invention makes possible rapid connection of electrodes to the hook of a lifting appliance, whereby manual handling of the hook is unnecessary since the coupling means is arranged on the hook of the lifting appliance and by use of this coupling means an electrode can be taken up on the hook and can again be detached therefrom. Thus it is possible to carry out both the insertion of new electrodes in an arc furnace and the removal of expended electrodes rapidly and without manual labor in the area of the arc furnace.

To avoid manual labor during connection of the electrode to the lifting appliance or when detaching the electrode from the lifting appliance, the coupling means of the invention has a controllable locking means, by the actuation of which the electrode can be connected with the hook of the lifting appliance or can again be detached therefrom, whereby the control of this locking means can either be performed automatically or by remote control.

To avoid manual labor when bringing the coupling means together with the connector element of an electrode, the coupling means of the invention has further an insertion device or guiding means by means of which the connector element of the electrode is guided into the area of the locking means. The driver of the lifting appliance therefore only has to lower the coupling means approximately into the area of the connector element of an electrode, whereupon the coupling means or its locking means is automatically centered in relation to the connector element during the further lowering of the coupling means, so that the locking means of the coupling means safely engages the connector element of the electrode.

Since the material of the active portions of the relevant electrodes, e.g. graphite, is highly sensitive to shocks and the like, care has been taken with the coupling means of the invention to ensure that during the coupling phase, damage to the electrode or to the connector portions is avoided. Thus the coupling means of the invention has a suspension device for shock absorption which is movable in the direction of insertion relative to the locking means. By the use of this arrangement, when the coupling means impacts the electrode and when the electrode is being raised or lowered, inadmissible percussive forces are absorbed, whereby damage to the active portions of the electrode or to the connector portions or to the other components is avoided.

It is expedient for the coupling means to comprise a housing in which the important components are placed. Thus the components of the coupling means are reliably protected despite the rough and dusty operations during steel manufacture.

According to a further advantageous embodiment, the locking means is controllable either pneumatically or hydraulically. The control, as will be more fully described later, can be carried out during the placing of the coupling means on the electrode or during the detachment of the coupling means from the electrode either on the basis of this process itself or by remote control by an operator, e.g. the driver of the lifting appliance.

One preferred embodiment of the lock comprises a locking bolt which is movable perpendicularly to the direction of insertion or insertion axis from an open position into a locked position and vice-versa. Thus not only is the locking means itself particularly simple in design and reliable in operation, but the result is a design of the connector element of the respective electrode which is free of problems.

This locking bolt is expediently movable by means of a pneumatic or hydraulic actuating cylinder, which permits a plurality of control possibilities.

In order to protect the actuating cylinder against rough operations during steel production and to ensure its reliable functioning, the actuating cylinder is arranged in the casing above the locking bolt and parallel thereto.

This arrangement further results in a simple design of the locking means, because the piston rod of the actuating cylinder and the locking bolt are interconnected drivingly by a tie-rod, preferably parallel to the insertion direction or insertion axis.

In one especially advantageous embodiment of the coupling means, in which it can be controlled by the respective operating process itself, the actuating cylinder is actuated by a control device in such manner than when the coupling means is placed on the connector element of an electrode, the locking bolt is moved from the open position into the locked position. When a lifting force is exerted on the coupling means, the locking bolt is retained in the locked position and/or when there is no lifting force or a certain minimum valve of the force is not attained, the locking bolt is moved from the locked position into the open position.

In the case of this embodiment, the control device, when the coupling means is placed on the connector element of the electrode, can receive the necessary control impulse, which causes the locking bolt to move from the open position to the locked position, in any suitable manner. For example, it is possible to provide a mechanical sensor, which is switched on when the connector element of the electrode is fully inserted into the entry guide arrangement, since in this position the locking bolt of the coupling means can enter a corresponding aperture in the connector element of the electrode.

While the respective electrode is suspended from the lifting appliance, for safety reasons it is necessary to ensure that the locking device of the coupling means is not unintentionally released, i.e. due to an operating error. This measure is achieved in that while a lifting force is exerted on the coupling means, the locking bolt is retained in the locked position. This retention should be understood to mean that even if the device is actuated which serves to move the locking bolt from the locked position into the open position by means of actuating cylinder, this process will not be accomplished as long as the lifting force is acting upon the coupling means, i.e. the electrode is hanging unsupported from the hook of the lifting appliance.

On the other hand, when the electrode is placed on the floor or after the placing of an electrode in the holder provided for the purpose on the roof of the arc furnace, the coupling means of the invention is intended to be released automatically, i.e. without an operator having to approach the coupling means. This object too can be attained by dependence on lifting force, in that only when no such force is present or when a certain minimum value of the force is not attained, is the locking bolt moved out of the locked position into the open position.

The lifting force acting upon the coupling means can be measured in any suitable way, and from the measurement the relevant control commands for the locking device are derived.

In a preferred embodiment in which the suspension means comprises a suspension bracket, which is supported movably on the housing of the coupling device via a spring or suspension device, which counteracts the lifting force arising in use, for the above-mentioned purpose the control device for the actuating cylinder can interact with any spring arrangement of the suspension bracket. Thus in this case, the control device senses the state of the spring arrangement so as to detect the lifting force acting on the coupling means, and depending thereon can generate the control command for the locking device.

Moreover, the above mentioned design of the suspension device by the use of a resilient suspension bracket also provides a simple construction, which nevertheless ensures the effective absorption of shock forces, which occur during the coupling process or when placing or lifting the electrode by means of the lifting appliance.

In a particularly simple design of the entry guide arrangement for the connector element, there is provided a narrowing, funnel-shaped wall element of the housing which narrows in the direction of introduction of the connector element of an electrode into the coupling means. This funnel-shaped narrowing wall element can be designed as one piece with the housing. To the inner end of this funnel-shaped wall element, the support for the actuating cylinder of the locking installation can be attached.

It is also expedient that the suspension bracket be connected with the housing so as to be rotatable around an axis parallel to the direction of insertion. In this case it is further an advantage that a, preferably adjustable, stop be provided for rotational limitation of the suspension bracket in relation to the housing. By the use of this design it is possible also to use the coupling means to screw a new active portion directly, by use of the lifting appliance, onto the lower end of a partly expended electrode by means of a screw nipple.

This purpose is attained by another design variant wherein the connector element is rotatably connected with the electrode for rotation about the axis thereof and a preferably adjustable stop is provided to limit rotation of the connector element in relation to the electrode. By using these two possible designs of the coupling means of the invention, special devices for the connection of a new active portion to the lower end of a partly expended electrode are unnecessary, since the coupling means can be used together with the lifting appliance directly for the screwing process.

Lastly, it is expedient that the connector element is connected with the electrode by a screw nipple, thereby facilitating attachment and detachment of electrode sections to the connector element.

The coupling means of the invention is therefore specially suitable for the transport of graphite and combination electrodes, for the introduction of removal of such electrodes into or out of holder devices in the roof of an arc furnace, for the resetting of such electrodes in the furnace as well as for screwing a new active portion to an expended active portion or to the metal shaft of a combination electrode.

Further advantages and details of the coupling means of the invention emerge from the specification of an embodiment of the basis of the enclosed drawings, in which.

Figure 1:
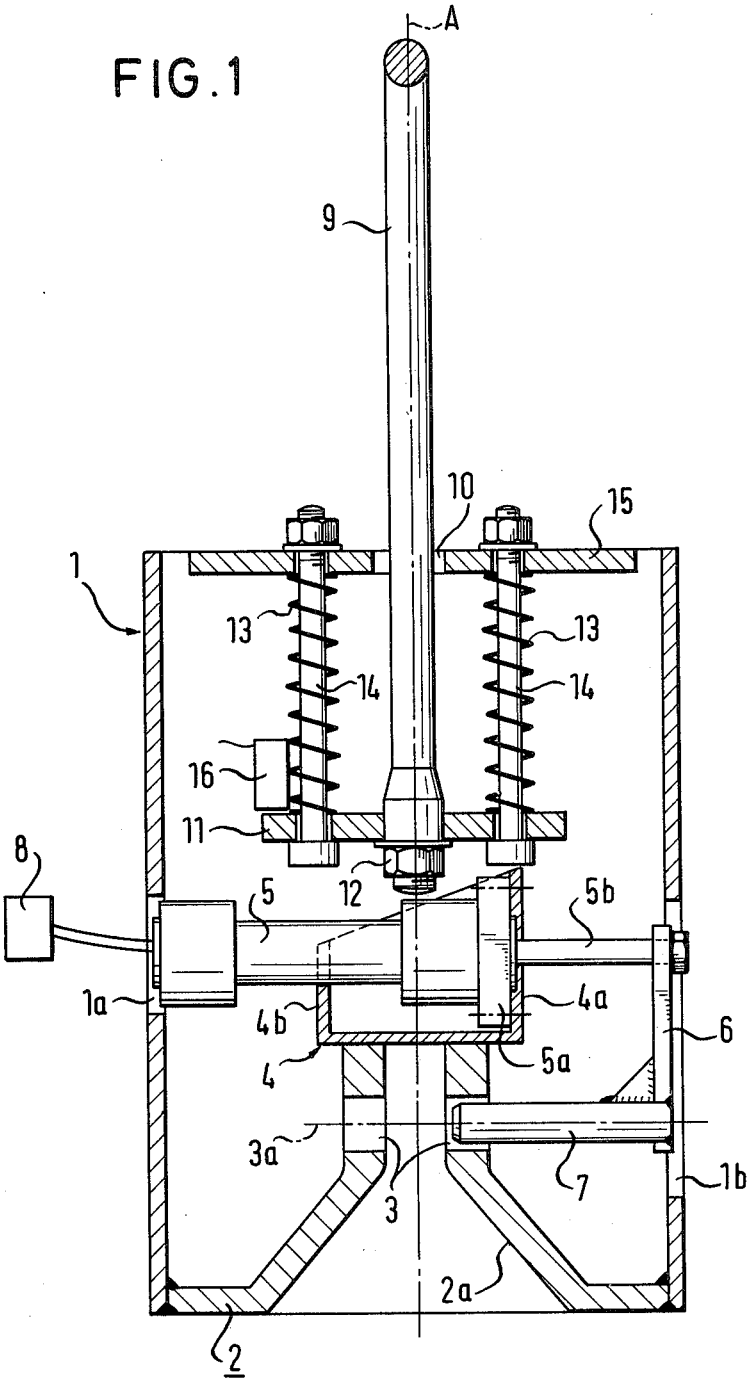
FIG. 1 shows a vertical section through the coupling means along the axis or the direction of insertion.
Figure 2:
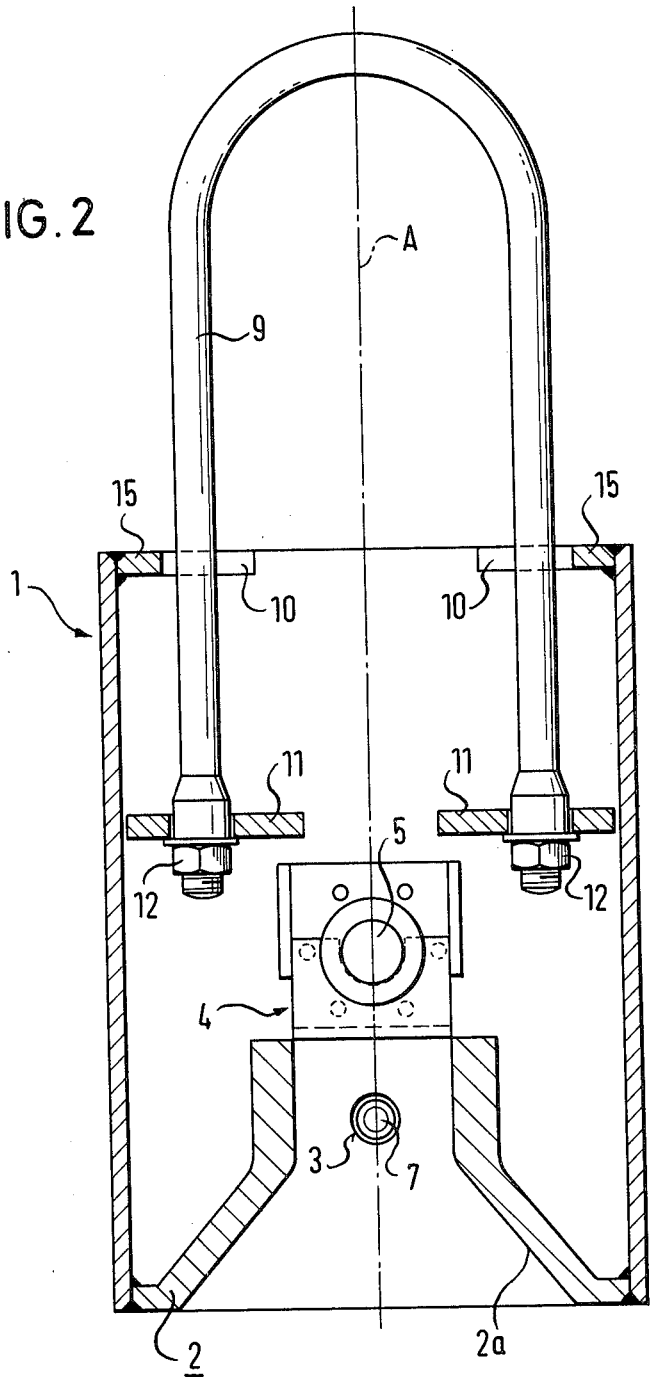
FIG. 2 shows a vertical section displayed by 90° relating to that of FIG. 1, for illustrative purposes.
Figure 3:
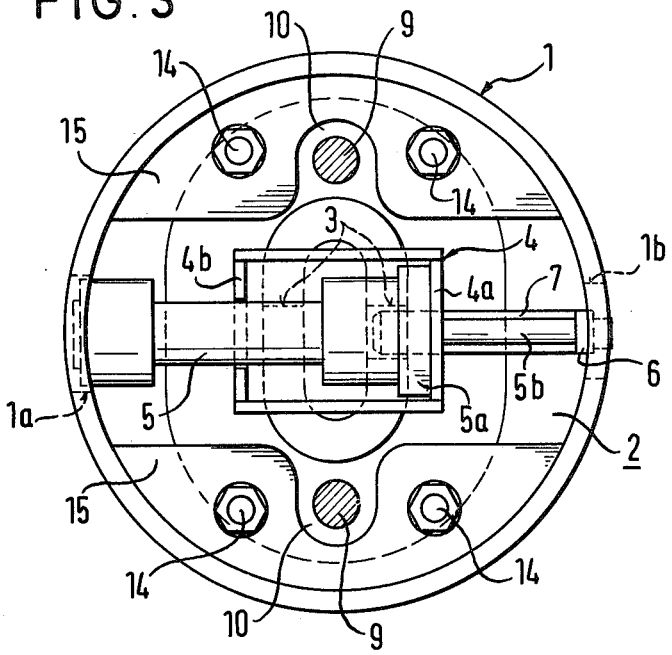
FIG. 3 shows a cross-section of the coupling means of FIGS. 1 and 2.

The illustrated coupling means comprises a housing 1 in the form of a tubular section having a longitudinal or insertion axis A. This housing 1 largely protects the important components of the coupling means from the rough operations occurring in steel manufacture. At the lower end of the tubular housing, a wall element 2 is welded on, the inner surface 2*a* of which forms a funnel-shaped entry guide or guiding means, which narrows towards the top, for guiding a connector element, to be described in more detail below, of an electrode. The wall element 2 further contains two boltholes 3, the axes 3*a* of which are mutually aligned and are perpendicular to the axis A, which also is parallel to the direction of insertion of the connector element.

A bearing housing 4 is supported on the top inner end of the wall element 2, and in housing 4 an actuating cylinder 5 of pneumatic or hydraulic type is located. For this purpose a flange 5*a* of the actuating cylinder 5 is screwed to a wall 4*a* which extends parallel to axis A, while additional support for actuating cylinder 5 is provided by a wall 5*b* parallel to wall 4*a* of the bearing housing 4. For simple insertion of actuating cylinder 5 in bearing housing 4, the housing 1 has an assembly aperture 1*a*. The end of the piston rod 5*b* of actuating cylinder 5 is drivingly connected via a tie-rod 6 extending parallel to axis A to a locking bolt 7, whose longitudinal axis is perpendicular to axis A and is aligned with the axes 3*a* of the locking holes 3, so that the locking bolt 7 can be inserted in and retained by locking holes 3. For ease of assembly of this arrangement, an assembly aperture 1*b* is provided in the housing 1.

To actuate the actuating cylinder 5, i.e. for motion of the piston and thus of the piston-rod 5*b* and of the locking bolt 7, the actuating cylinder 5 is connected in the usual way to a control arrangement, e.g. a solenoid valve arrangement 8.

The suspension device of the present coupling means comprises a U-shaped suspension bracket 9, having shanks engaging in the housing 1 through apertures 10. The free ends of the shanks are screwed to respective lifting plates 11 by means of respective nuts 12. Each lifting plate 11 is supported by two pressure springs 13, which are guided by respective spring bolts 14, on a respective support plate 15, which is in each case rigidly connected, e.g. by welding, to housing 1. Thereby, the suspension bracket 9 is movable in the axial direction A, i.e. in the direction of insertion, relative to the housing 1, and the lifting force exerted on the coupling means will be absorbed by the pressure springs 13.

To measure the force exerted by pressure springs 13 during the insertion of the coupling means, a measuring and control means 16, which is only shown schematically, is assigned to one of the pressure springs 13 and is coupled to the control arrangement 8, so that, depending on said force, the actuating cylinder 5 can be correspondingly controlled by the control arrangement 8.

Figure 4:
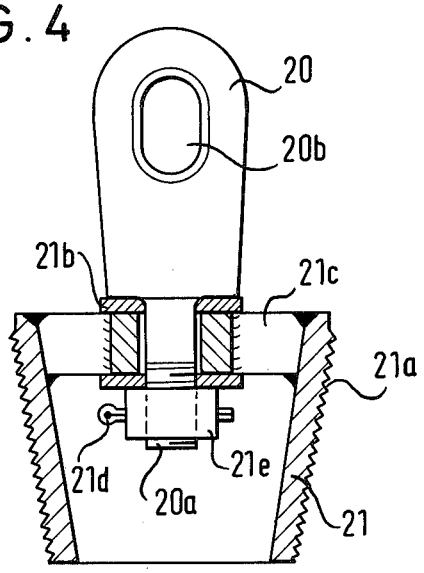
FIG. 4 shows a vertical section through a connector element and a connection nipple for an electrode.

For interaction with the coupling means described above, each electrode has the connector arrangement which is shown in FIG. 4. This comprises a shackle-shaped connector element 20 in which an aperture 20*b* is provided which, as will be more fully described below, is intended to accept the locking bolt 7 of the coupling means. This connector element 20 is rotatably connected to a screw nipple 21 having a conical external thread 21*a*. For this purpose, the connector element 20 is integral with a bolt 20*a*, which is inserted in a bearing sleeve 21*b* centrally arranged in a facing plate 21*c* of the screw nipple 21. To transfer the lifting forces from the connector element 20 to the screw nipple 21, a safety bolt 21*d* is provided which is passed through a hole in a safety ring 21*e* and simultaneously through a hole in bolt 20*a* of the connector element 20.

To limit the rotational path of the connector element 20 in relation to screw nipple 21, a stop is provided between the two elements (not shown), whereby after a certain rotational motion, further rotation in the same direction between the connector element 20 and the screw nipple 21 is prevented.

The connector element described above according to FIG. 4 is screwed into the upper front surface of an electrode, e.g. of the metal shaft of a combination electrode.

The method of operation of the coupling means described above is as follows:

The coupling means is attached to a hook of a lifting appliance by means of the suspension bracket 9. By the lifting appliance, the coupling means is then lowered onto an electrode equipped with a connector arrangement according to FIG. 4 so that the connector element 20 slides into the funnel-shaped entry guide arrangement 2, 2*a*, for which purpose the locking bolt 7 is in its open position. As soon as the aperture 20*b* of the connector element 20 of the electrode is aligned with the two locking holes 3 of the coupling means, locking bolt 7 is moved into the two holes 3 and the aperture 20*b* of the connector element, for which purpose the piston of the actuating cylinder 5 is correspondingly displaced. The corresponding activation of actuating cylinder 5 can either be carried out by a sensor actuated during the insertion of the connector element 20 in the funnel-shaped entry guide arrangement 2 or it can be remotely controlled by the driver of the lifting appliance.

In the locked position, described above, of locking bolt 7, the electrode grasped by the coupling means can now be raised by the lifting appliance and can be subjected to the transport and handling processes already described.

As long as the electrode is freely suspended from the hook of the lifting appliance and thus a corresponding force is exerted by the springs 19, the measuring and the control device 16 prevents unintentional release of the coupling means by the movement of the locking bolt 7 from the locked position described above into the open position.

On the other hand, if the electrode is either deposited on the floor or is introduced into the holder device on the roof of an arc furnace, and is fixed there, whereupon the hook of the lifting appliance will be lowered and thus the force exerted by the springs 13 falls below a minimum value or is zero, the coupling means can again be detached from the electrode. To do this, the actuating cylinder 5 is correspondingly controlled, so that the locking bolt 7 is moved from the locked position into the open position. This control of the actuating cylinder 5 can either be performed via remote control by the operator of the lifting appliance, or it can be dependent on an impulse from the measuring and control device 16.

The rotatable arrangement of the connector element 20 in the screw nipple 21 and the limitation of the rotation motion provided therefor serve the purpose of screwing on a new active portion by means of the coupling means onto the lower end of an expended electrode or on to the metal shaft of a combination electrode, since it is possible, when using the arrangement described, to rotate the electrode directly by means of the lifting appliance.

We claim:

1. In an arc furnace having at least one arc electrode removably retained within the arc furnace and including a connector element for use in lifting the electrode from the arc furnace employing a lifting appliance, and having a coupling for interconnecting the arc electrode and the lifting appliance, the coupling comprising: a lock configured for detachably engaging the connector element of the arc electrode; a guiding means configured to guide said connector element along an insertion axis into a position for engagement by the lock; and a suspension means interposed between the arc electrode and said lifting appliance including means for shockabsorbing and for accommodating relative motion in a direction parallel to said insertion axis between said suspension means and said lock.

2. A coupling means according to claim 1, the lock being operable employing a fluid under pressure.

3. A coupling means according to claim 1, the lock comprising a locking bolt movable in a direction perpendicular to the insertion axis between an unlocked and a locked position.

4. A coupling means according to claim 3, said lock being movable by means of a fluid actuated cylinder.

5. A coupling means according to claim 4, said fluid actuated cylinder being arranged in a housing above the lock and having an operating movement axis parallel to an operating axis of the lock.

6. A coupling means according to claim 5, a piston rod of the fluid actuated cylinder and the lock being connected together for driven movement of the lock by a tie-rod.

7. In an arc furnace having at least one arc electrode removably retained within the arc furnace and including a connector element for use in lifting the electrode from the arc furnace employing a lifting appliance, and having a coupling for interconnecting the arc electrode and the lifting appliance, the coupling comprising: a lock configured for detachably engaging the connector element of the arc electrode; a guiding means configured to guide said connector element along an insertion axis into a position for engagement by the lock; and a suspension means interposed between the arc electrode and said lifting appliance including a means for shock absorbing and for accommodating relative motion in a direction parallel to said insertion axis between said suspension device and said lock and including a control means positioned and arranged whereby movement of the suspension means under imposition of some portion of the weight of the arc electrode upon the suspension means restrains movement of the lock from a locked to an unlocked position, the lock having an elongated axis and moving along the elongated axis to engage the connector element, actuated movement of the lock being accomplished by a fluid driven cylinder operating along an axis parallel to the elongated axis of the lock and drivingly interconnected with the lock.

8. A coupling means according to claim 7, the suspension means comprising a suspension member, springably joined to the lock to define said shock-absorbing means.

9. A coupling means according to claim 8, the suspension member being mounted for rotation about an axis parallel to the insertion axis.

10. A coupling means according to claim 9, an adjustable stop being arranged to limit rotary motion of the suspension bracket.

11. A coupling means according to claim 8, 9 or 10, characterized in that the control means for the fluid driven cylinder interacts with said suspension member.

12. A coupling means according to any one of claims 1 or 7 the guide means being formed by a funnel-shaped wall element, which narrows along said insertion axis.

13. A coupling means according to any one of the claims 1 or 7 in combination with the arc electrode engaged by said lock, the connector means of the electrode being rotatably connected to the electrode for rotation about the longitudinal axis thereof.

14. A coupling means according to claim 13, an adjustable stop being employed to limit rotary motion of the connector means in relation to the electrode.

15. A coupling means according to any one of claims 1 or 7, characterized in that the connector means is joined to the electrode by means of a screw nipple.

16. A coupling means according to any one of claims 1 and 3–7, the suspension means comprising a suspension member springably joined to the lock to define a shock-absorbing means.

* * * * *